US007206383B2

(12) United States Patent
Zhao et al.

(10) Patent No.: US 7,206,383 B2
(45) Date of Patent: Apr. 17, 2007

(54) COLLIMATOR, X-RAY IRRADIATOR, AND X-RAY APPARATUS

(75) Inventors: Yang Zhao, Beijing (CN); Xu Xiaodong, Beijing (CN)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 32 days.

(21) Appl. No.: 11/017,182

(22) Filed: Dec. 20, 2004

(65) Prior Publication Data

US 2005/0152499 A1 Jul. 14, 2005

(30) Foreign Application Priority Data

Dec. 29, 2003 (CN) ..... 2003 1 0124909X

(51) Int. Cl.
*G21K 1/02* (2006.01)

(52) U.S. Cl. ..... 378/148; 378/150

(58) Field of Classification Search ..... 378/148, 378/150, 151

See application file for complete search history.

(56) References Cited

U.S. PATENT DOCUMENTS 3,668,402 A * 6/1972 Palermo et al. ..... 378/150
4,200,803 A 4/1980 Becker et al.
4,277,685 A 7/1981 Covic et al.
5,436,958 A 7/1995 Taylor
5,438,454 A 8/1995 Ludewigt et al.
6,449,340 B1 9/2002 Tybinkowski et al.
6,788,764 B2 9/2004 Saladin et al.
2002/0126799 A1 * 9/2002 Saladin et al. ..... 378/152

FOREIGN PATENT DOCUMENTS

JP 2002-355242 12/2002

OTHER PUBLICATIONS

Xiaodong Xu et al., Patent Application "Collimator, X-Ray Irradiator, And X-Ray Apparatus" filed Nov. 4, 2004, 17 pgs.

* cited by examiner

*Primary Examiner*—Edward J. Glick
*Assistant Examiner*—Chih-Cheng Glen Kao
(74) *Attorney, Agent, or Firm*—Carl B. Horton, Esq.; Armstrong Teasdale LLP

(57) ABSTRACT

A collimator includes a pair of first plate members which define an X-ray passing aperture by a spacing between their opposed end faces, a second plate member which is movable in a direction parallel to a moving direction of the first plate members, a pair of third plate members which are movable symmetrically with each other in a direction perpendicular to the moving direction of the first plate member and which define an X-ray passing aperture by a spacing between their opposed end faces, and a fourth plate member which is movable in a direction parallel to the moving direction of the third plate members.

12 Claims, 15 Drawing Sheets

COLLIMATOR, X-RAY IRRADIATOR, AND X-RAY APPARATUS

CROSS REFERENCE TO RELATED APPLICATIONS

This application claims the benefit of Chinese Application No. 2003-10124909.X filed Dec. 29, 2003.

BACKGROUND OF THE INVENTION

The present invention relates to a collimator, as well as an X-ray irradiator and an X-ray apparatus. Particularly, the invention is concerned with a collimator for restricting an irradiation range of X-ray, as well as an X-ray irradiator and an X-ray apparatus both provided with such a collimator.

In an X-ray irradiator there is used a collimator for restricting an irradiation range of X-ray. The collimator has an aperture permitting X-ray to pass therethrough and has a structure such that X-ray cannot pass through the collimator except through the aperture. With this structure, the irradiation range of X-ray can be adjusted.

A collimator having a variable aperture is provided with movable plate members, namely, blades having X-ray absorbability. As the blades there are used a pair of blades opposed to each other at respective end faces. The pair of blades are movable in directions opposite to each other in a plane parallel to their surfaces. For expanding the aperture, the pair of blades are moved in directions away from each other, while for narrowing the aperture, the blades are moved toward each other.

Two pairs of such blades are combined perpendicularly to each other to afford a collimator wherein the size of aperture can be changed in two directions perpendicular to each other. In such a collimator, by making all of the blades adjustable independently, it is possible to adjust not only the size of aperture but also a two-dimensional position thereof (see, for example, Patent Literature 1).

[Patent Literature 1] Japanese Published Unexamined Patent Application No. 2002-355242 (pages 2 to 3, FIGS. 1 to 2)

In the above collimator, in order to make all of the blades adjustable independently, it is necessary to use special blades and a drive mechanism for the blades.

SUMMARY OF THE INVENTION

Therefore, it is an object of the present invention to provide a collimator having a high degree of freedom for adjusting an aperture without the need of any special blades and drive mechanism, as well as an X-ray irradiator and an X-ray apparatus both provided with such a collimator.

(1) The present invention, in one aspect thereof for solving the above-mentioned problem, resides in a collimator comprising: a pair of first plate members having X-ray absorbability, being movable symmetrically with each other in a direction parallel to surfaces thereof, and defining an X-ray passing aperture by a spacing between respective end faces opposed to each other; a second plate member disposed spacedly from the first plate member in a direction perpendicular to the surfaces of the first plate members, having X-ray absorbability, and being movable in a direction parallel to a surface thereof and parallel to the moving direction of the first plate members; a pair of third plate members disposed spacedly from the first and second plate members in a direction perpendicular to the surfaces of the first and second plate members, having X-ray absorbability, being movable symmetrically with each other in a direction parallel to surfaces thereof and perpendicular to the moving direction of the first plate members, and defining an X-ray passing aperture by the spacing between respective end faces opposed to each other; and a fourth plate member disposed spacedly from the first, second and third plate members in a direction perpendicular to the surfaces of the first, second and third plate members, having X-ray absorbability, and being movable in a direction parallel to a surface thereof and parallel to the moving direction of the third plate members.

(2) The present invention, in another aspect thereof for solving the above-mentioned problem, resides in an X-ray irradiator comprising an X-ray tube and a collimator for collimating X-ray generated from the X-ray tube, the collimator comprising: a pair of first plate members having X-ray absorbability, being movable symmetrically with each other in a direction parallel to surfaces thereof, and defining an X-ray passing aperture by a spacing between respective end faces opposed to each other; a second plate member disposed spacedly from the first plate members in a direction perpendicular to the surfaces of the first plate members, having X-ray absorbability, and being movable in a direction parallel to a surface thereof and parallel to the moving direction of the first plate members; a pair of third plate members disposed spacedly from the first and second plate members in a direction perpendicular to the surfaces of the first and second plate members, having X-ray absorbability, being movable symmetrically with each other in a direction parallel to surfaces thereof and perpendicular to the moving direction of the first plate members, and defining an X-ray passing aperture by the spacing between respective end faces opposed to each other; and a fourth plate member disposed spacedly from the first, second and third plate members in a direction perpendicular to the surfaces of the first, second and third plate members, having X-ray absorbability, and being movable in a direction parallel to the moving direction of the third plate members.

(3) The present invention, in a further aspect thereof for solving the above-mentioned problem, resides in an X-ray apparatus comprising an X-ray tube, a collimator for collimating X-ray generated from the X-ray tube and applying the collimated X-ray to an object to be radiographed, and a detector means for detecting the X-ray which has passed through the object to be radiographed, the collimator comprising: a pair of first plate members having X-ray absorbability, being movable symmetrically with each other in a direction parallel to surfaces thereof, and defining an X-ray passing aperture by a spacing between respective end faces opposed to each other; a second plate member disposed spacedly from the first plate members in a direction perpendicular to the surfaces of the first plate members, having X-ray absorbability, and being movable in a direction parallel to a surface thereof and parallel to the moving direction of the first plate members; a pair of third plate members disposed spacedly from the first and second plate members in a direction perpendicular to the surfaces of the first and second plate members, having X-ray absorbability, being movable symmetrically with each other in a direction parallel to surfaces thereof and perpendicular to the moving direction of the first plate members, and defining an X-ray passing aperture by a spacing between respective end faces opposed to each other; and a fourth plate member disposed spacedly from the first, second and third plate members in a direction perpendicular to the surfaces of the first, second and third plate members, having X-ray absorbability, and being movable in a direction parallel to a surface thereof and parallel to the moving direction of the third plate members.

In the invention in each of the above aspects, the first and third plate members, which are combined perpendicularly to each other to form a quadrangular aperture, are further combined with the second and fourth plate members which are perpendicular to each other and which are adapted to operate independently of each other, whereby it is possible to adjust the aperture at a high degree of freedom without the need of using any special blades and drive mechanism.

For enhancing the degree of freedom in forming the aperture it is preferable that the second plate member and the fourth plate member be movable independently of each other. For facilitating the assembly of the collimator it is preferable that the first and second plate members be constructed as a unitized combination and that the third and fourth plate members be constructed as a unitized combination.

For making it possible to combine sub-units according to purposes of use it is preferable that the combined unit of the first and second plate members be subunitized for each of the plate members and that the combined unit of the third and fourth plate members be subunitized for each of the plate members.

According to the present invention, it is possible to provide a collimator having a high degree of freedom for adjusting an aperture without the need of any special blades and drive mechanism, as well as an X-ray irradiator and an X-ray apparatus both provided with such a collimator.

Further objects and advantages of the present invention will be apparent from the following description of the preferred embodiments of the invention as illustrated in the accompanying drawings.

DETAILED DESCRIPTION OF THE INVENTION

Figure 1:
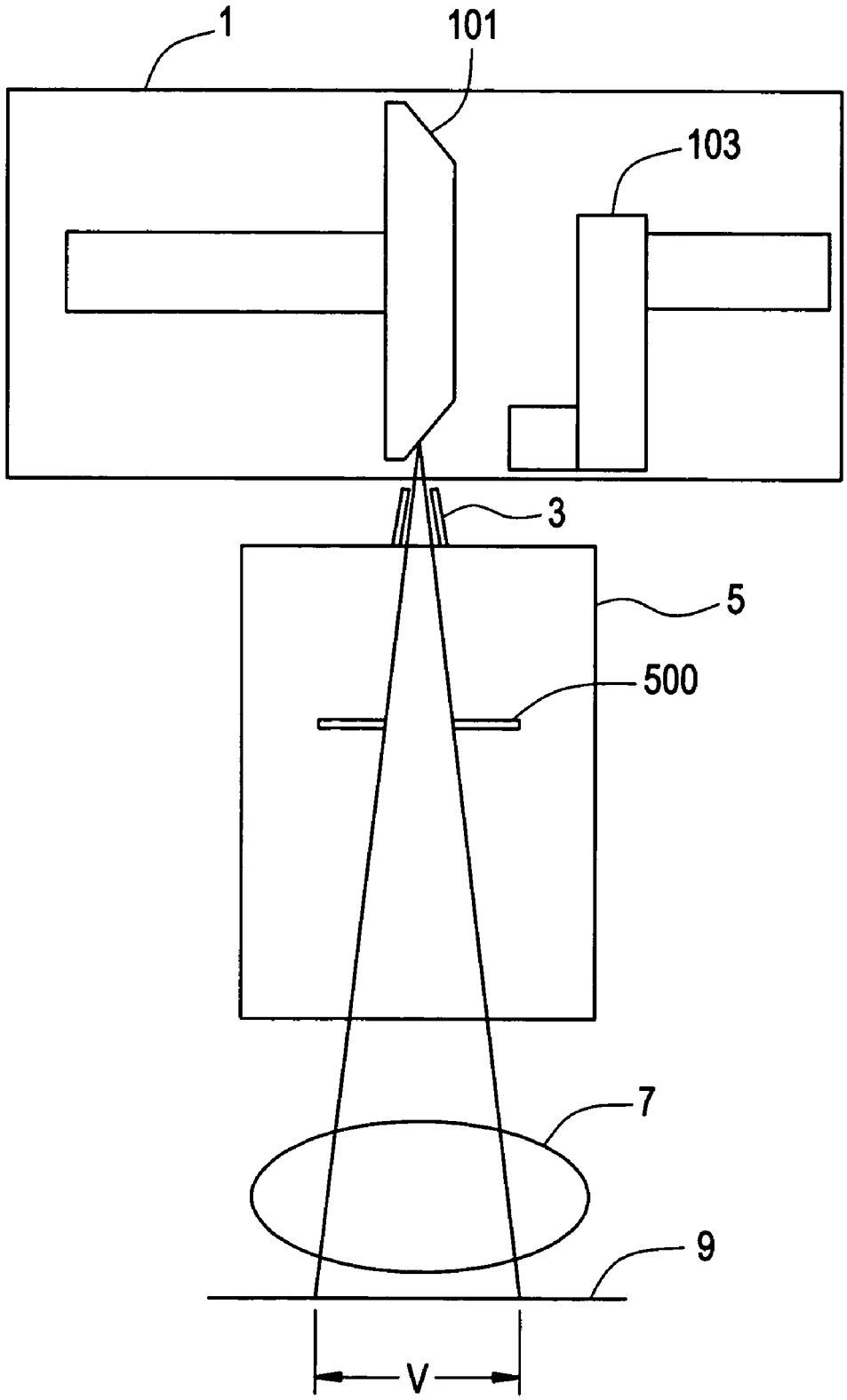
FIG. 1 illustrates a schematic construction of an X-ray apparatus.

An embodiment of the present invention will be described in detail hereinunder with reference to the drawings. FIG. 1 illustrates a schematic construction of an X-ray apparatus. This apparatus is an example of a mode for carrying out the invention. With the construction of this apparatus there is shown an example of a mode for carrying the invention with respect to the apparatus thereof.

In this X-ray apparatus, as shown in the same figure, X-ray generated from an X-ray tube 1 is diaphragmed by an X-ray diaphragm 3 and is collimated by a collimating plate 500 disposed within a collimator 5, then the collimated X-ray is applied toward an object 7 to be radiographed and transmitted X-ray is detected by a detector 9. The X-ray tube 1 is an example of a mode for carrying out the invention with respect to the X-ray tube defined herein. The collimator 5 is an example of a mode for carrying out the invention with respect to the collimator of the invention. The detector 9 is an example of a mode for carrying out the invention with respect to the detector means defined herein.

The portion comprising the X-ray tube 1, X-ray diaphragm 3 and collimator 5 is an example of a mode for carrying out the invention with respect to the X-ray irradiator of the invention. With the construction of this apparatus there is shown an example of a mode for carrying out the invention with respect to the X-ray irradiator of the invention. The collimator 5 is an example of a mode for carrying out the invention with respect to the collimator of the invention. With the construction of this apparatus there is shown an example of a mode for carrying out the invention with respect to the collimator of the invention.

The X-ray tube 1 has an anode 101 and a cathode 103, and X-ray is generated from a point of collision (focus) of electrons which are emitted from the cathode 103 toward the anode 101. The X-ray thus generated is applied to the object through the X-ray diaphragm 3 and the collimator 5. The X-ray diaphragm 3 is constructed of an X-ray absorbing material such as lead for example. The collimating plate 500 in the collimator 5 is also constructed of an X-ray absorbing material such as lead for example.

The X-ray diaphragm 3 shapes the X-ray generated from the X-ray tube 1 so that the X-ray becomes a quadrangular pyramid-like beam with an X-ray focus on the anode 101 as a vertex. The collimator 5 defines an X-ray irradiation field V by an aperture which is formed by the collimating plate 500. The aperture is variable to adjust the X-ray irradiation field V.

Figure 2:
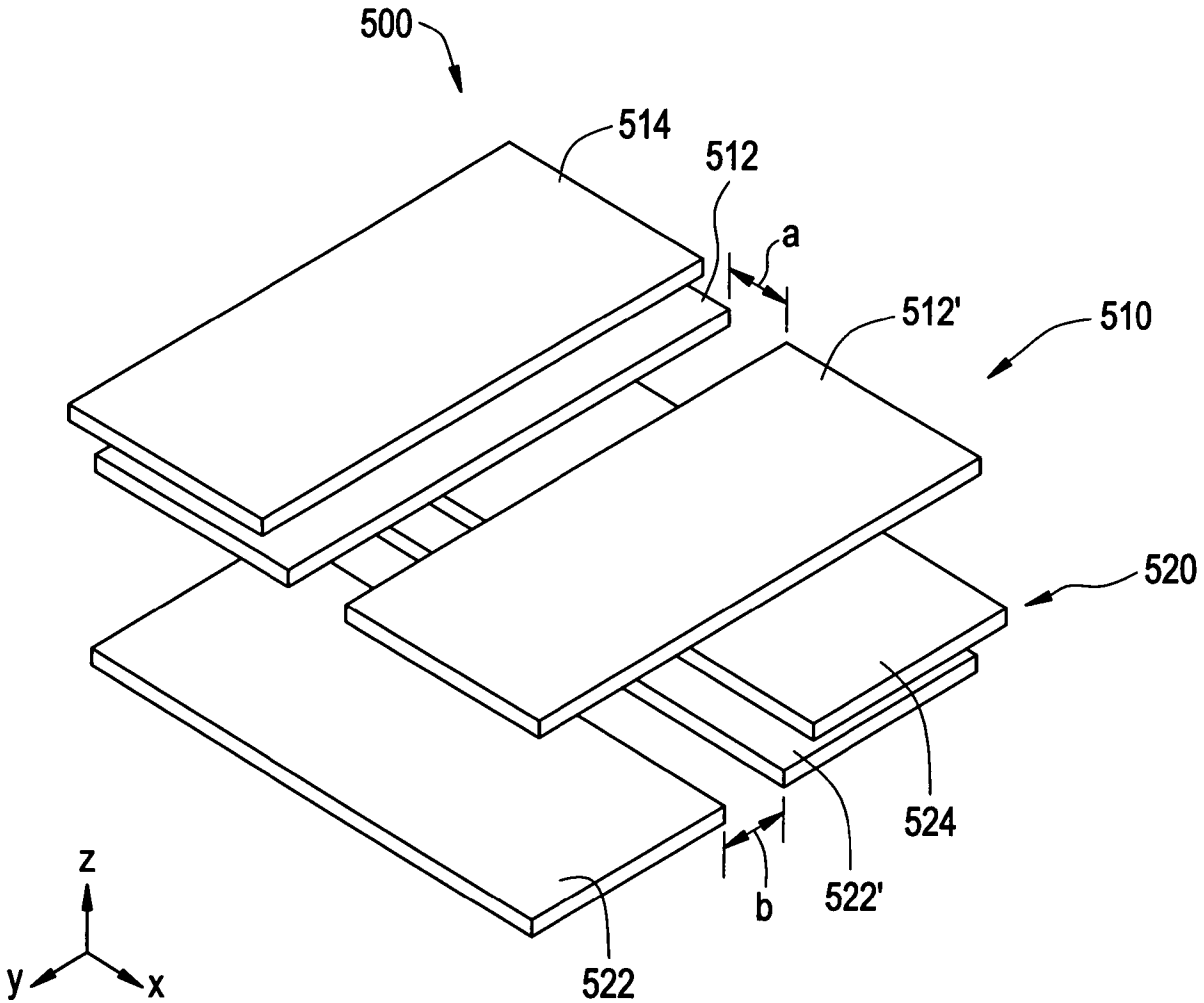
FIG. 2 illustrates the construction of a principal portion of a collimating plate.

Reference will be made to the collimating plate 500 in the collimator 5. FIG. 2 shows the construction of a principal portion of the collimating plate 500. As shown in the same figure, the collimating plate 500 comprises two vertical stages of collimating plates which are an upper collimating plate 510 and a lower collimating plate 520. In the same figure, three mutually perpendicular directions are assumed to be x, y, and z directions, z being the vertical direction. The X-ray is radiated from above.

The upper collimating plate 510 has a pair of symmetric blades 512, 512' and a single blade 514, which are all rectangular plates and are constructed of an X-ray absorbing material such as lead for example.

The symmetric blades 512 and 512' lie on the same plane and their long sides are parallel to each other, while their short sides corresponding to each other lie on the same straight lines respectively. The symmetric blades 512 and 512' are displaceable in their short side direction (x direction), whereby a distance "a" between their mutually opposed end faces can be adjusted. The symmetric blades 512 and 512' are an example of a mode for carrying out the invention with respect to the first plate members defined herein.

The single blade 514 lies on a horizontal plane positioned above the symmetric blades 512 and 512' and its long and short sides are parallel respectively to the long and shorts sides of the symmetric blades 512 and 512'. The single blade 514 is also displaceable in its short side direction (x direction). The single blade 514 is an example of a mode for carrying out the invention with respect to the second plate member defined herein.

Figure 3:
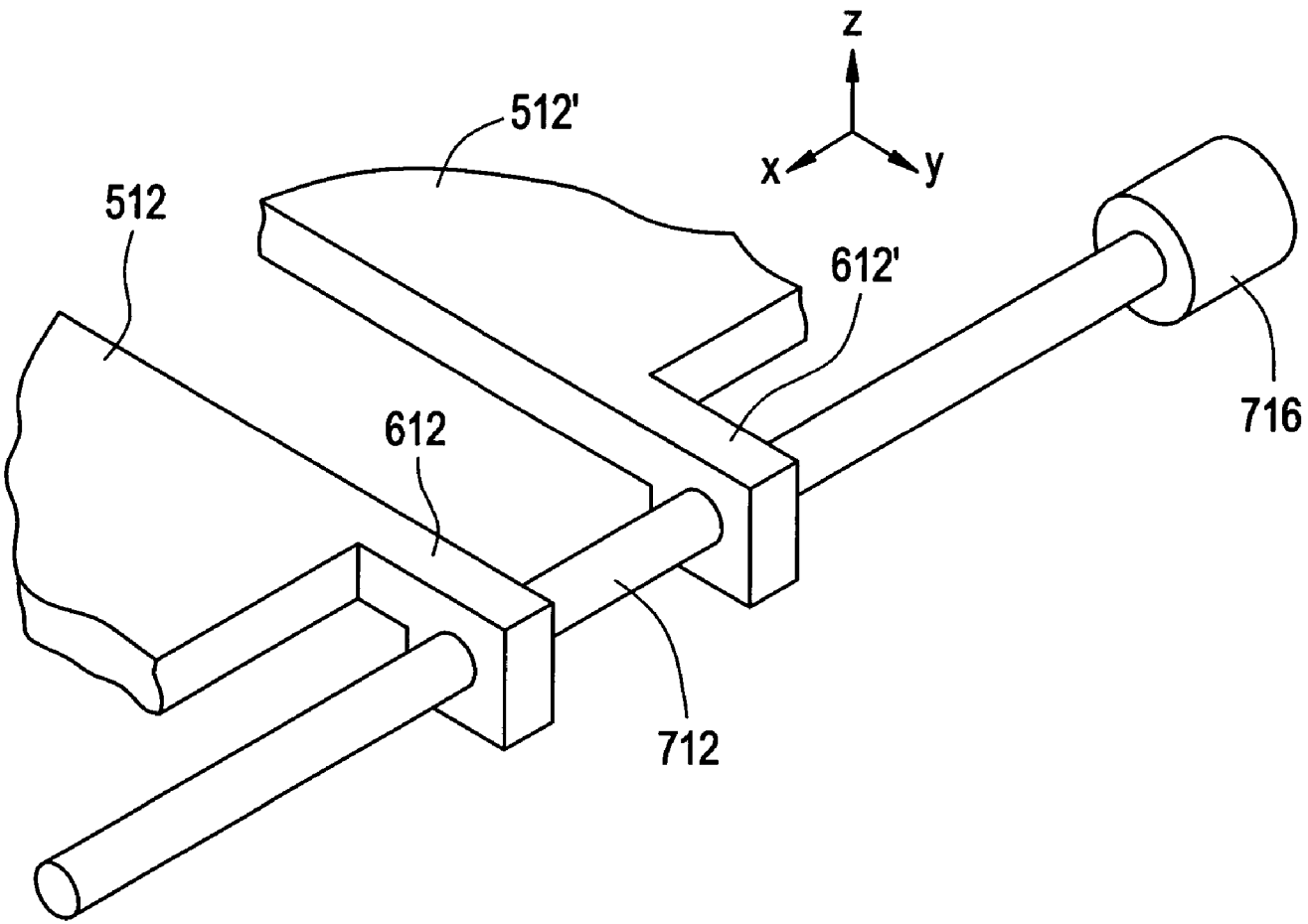
FIG. 3 illustrates the construction of a drive mechanism.

The symmetric blades 512 and 512' are position-adjustable in x direction independently of each other. A schematic construction of a drive mechanism which permits such a positional adjustment is shown in FIG. 3. As shown in the same figure, the symmetric blades 512 and 512' have arms 612 and 612', respectively, which extend in y direction. The arms 612 and 612' are engaged at end portions thereof with a shaft 712.

The shaft 712, which extends in x direction, is threaded throughout the overall length thereof so that the threads are reverse right and left with a mid portion of the shaft 712 as a boundary. The end portions of the arms 612 and 612' engaged with the shaft 712 are internally threaded correspondingly to the threads on the shaft 712. A motor 716 is mounted on one end of the shaft 712. The motor 716 is a reverse-rotatable motor and is controlled by a control means (not shown).

With rotation in one direction of the motor 716, the symmetric blades 512 and 512' are displaced toward each other, while with rotation in the opposite direction of the motor, the symmetric blades 512 and 512' are displaced away from each other. That is, the symmetric blades 512 and 512' are displaced symmetrically with each other.

Figure 4:
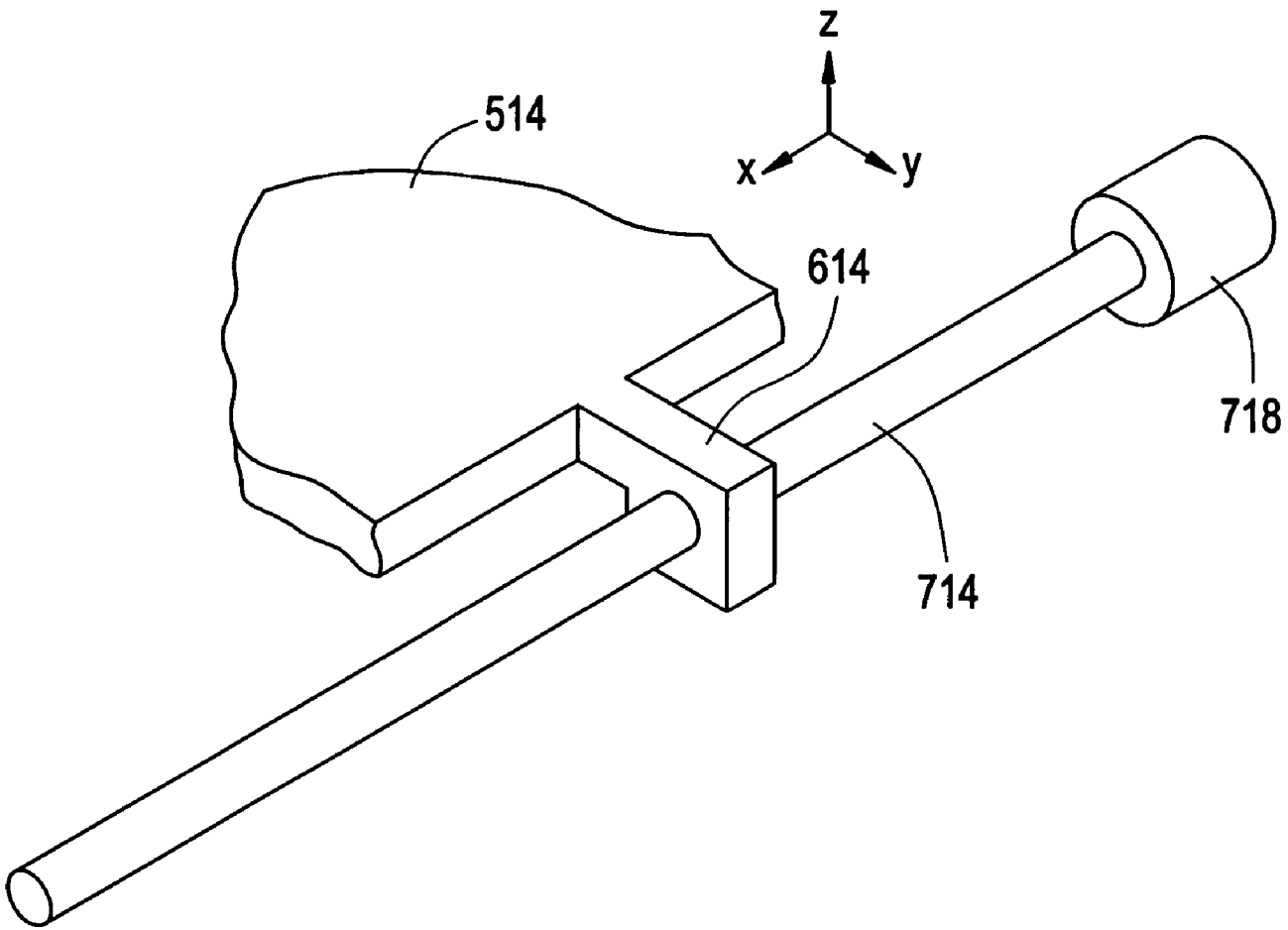
FIG. 4 illustrates the construction of a drive mechanism.

The position of the single blade 514 is adjustable in x direction. A schematic construction of a drive mechanism which permits such position adjustment is shown in FIG. 4. As shown in the same figure, the single blade 514 has an arm 614 extending in y direction. An end portion of the arm 614 is engaged with a shaft 714.

The shaft 714, which extends in x direction, is threaded throughout the overall length thereof. The end portion of the arm 614 engaged with the shaft 714 is internally threaded correspondingly to the threads on the shaft 714. A motor 718 is mounted on one end of the shaft 714. The motor 718 is a reverse-rotatable motor. With rotation in one direction of the motor 718, the single blade 514 is displaced in one direction along the shaft 714, while with rotation in the opposite direction of the motor, the single blade 514 is displaced in the opposite direction. The motor 718 is controlled independently of the motor 716 by a control means (not shown).

The lower collimating plate 520 is of the same construction as the upper collimating plate 510. That is, the lower collimating plate 520 has a pair of symmetric blades 522, 522' and a single blade 524. The symmetric blades 522, 522' and the single blade 524 are all rectangular plates and are formed of an X-ray absorbing material such as lead for example.

A horizontal plane where the symmetric blades 522, 522' and the single blade 524 are present is positioned below the horizontal plate where the symmetric blades 512 and 512' of the upper collimating plate 510 are present. The long-side direction of the symmetric blades 522, 522' and the single blade 524 is perpendicular to the long-side direction of the symmetric blades 512 and 512' of the upper collimating plate 510.

The symmetric blades 522 and 522' are displaceable in the short-side direction (y direction), thereby permitting adjustment of the distance "b" between their end faces opposed to each other. Position adjustment of the symmetric blades 522 and 522' is made by a drive mechanism which is the same as the drive mechanism shown in FIG. 3. The drive mechanism for the symmetric blades 522 and 522' is independent of the drive mechanism for the symmetric blades 512 and 512'. The symmetric blades 522 and 522' are an example of a mode for carrying out the invention with respect to the third plate members defined herein.

The single blade 524 is also displaceable in its short-side direction (y direction). Position adjustment of the single blade 524 is made by a drive mechanism which is the same as the drive mechanism shown in FIG. 4. The drive mechanism for the single blade 524 is independent of the drive mechanism for the single blade 514. The single blade 524 is an example of a mode for carrying out the invention with respect to the fourth plate member defined herein.

With the collimating plate 500 of such a construction, there is formed a quadrangular aperture for the X-ray emitted from the X-ray tube 1. FIGS. 5 to 14 illustrate in what state the aperture is formed.

Figure 5:
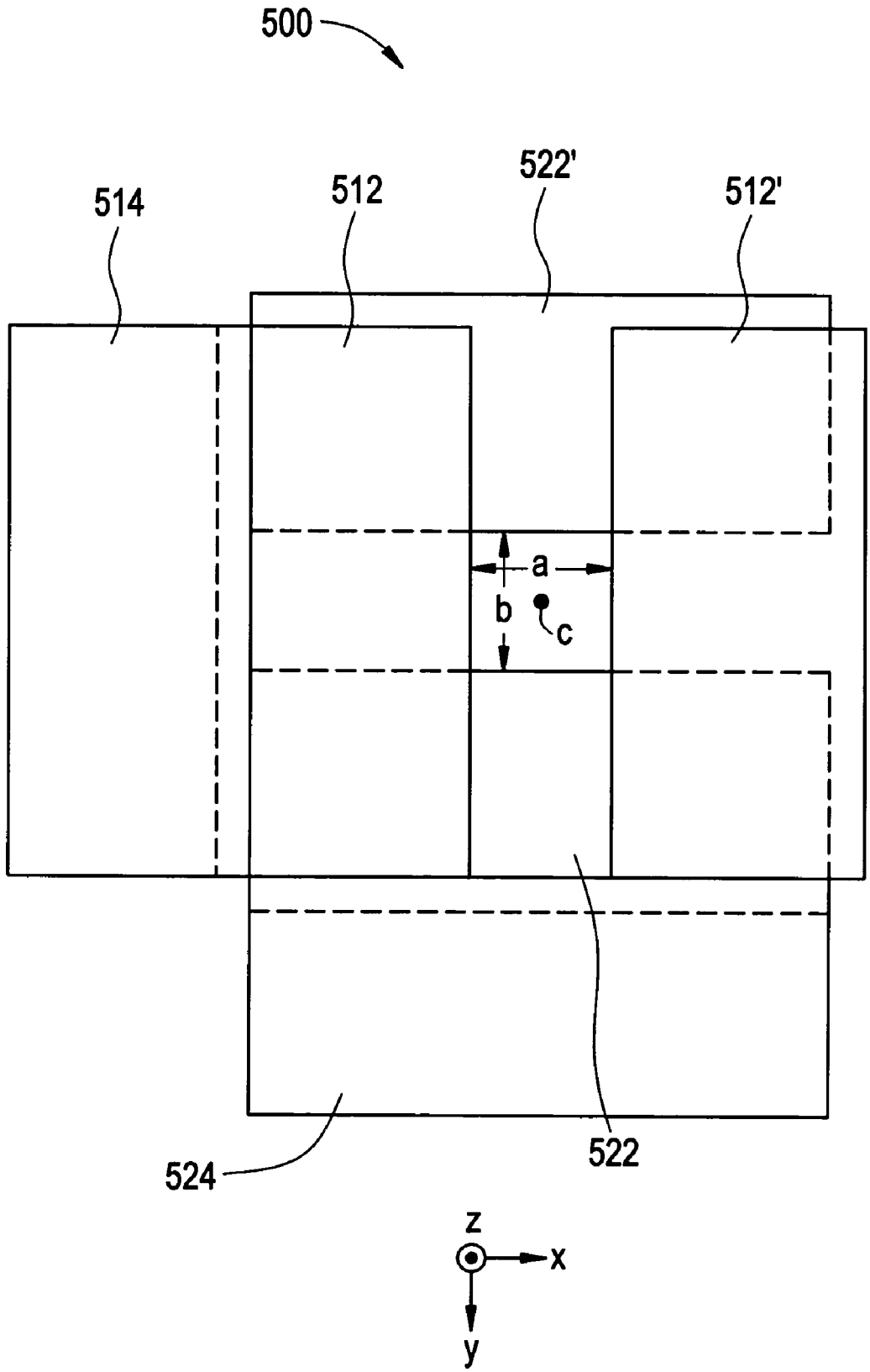
FIG. 5 illustrates in what state an aperture is formed.
Figure 6:
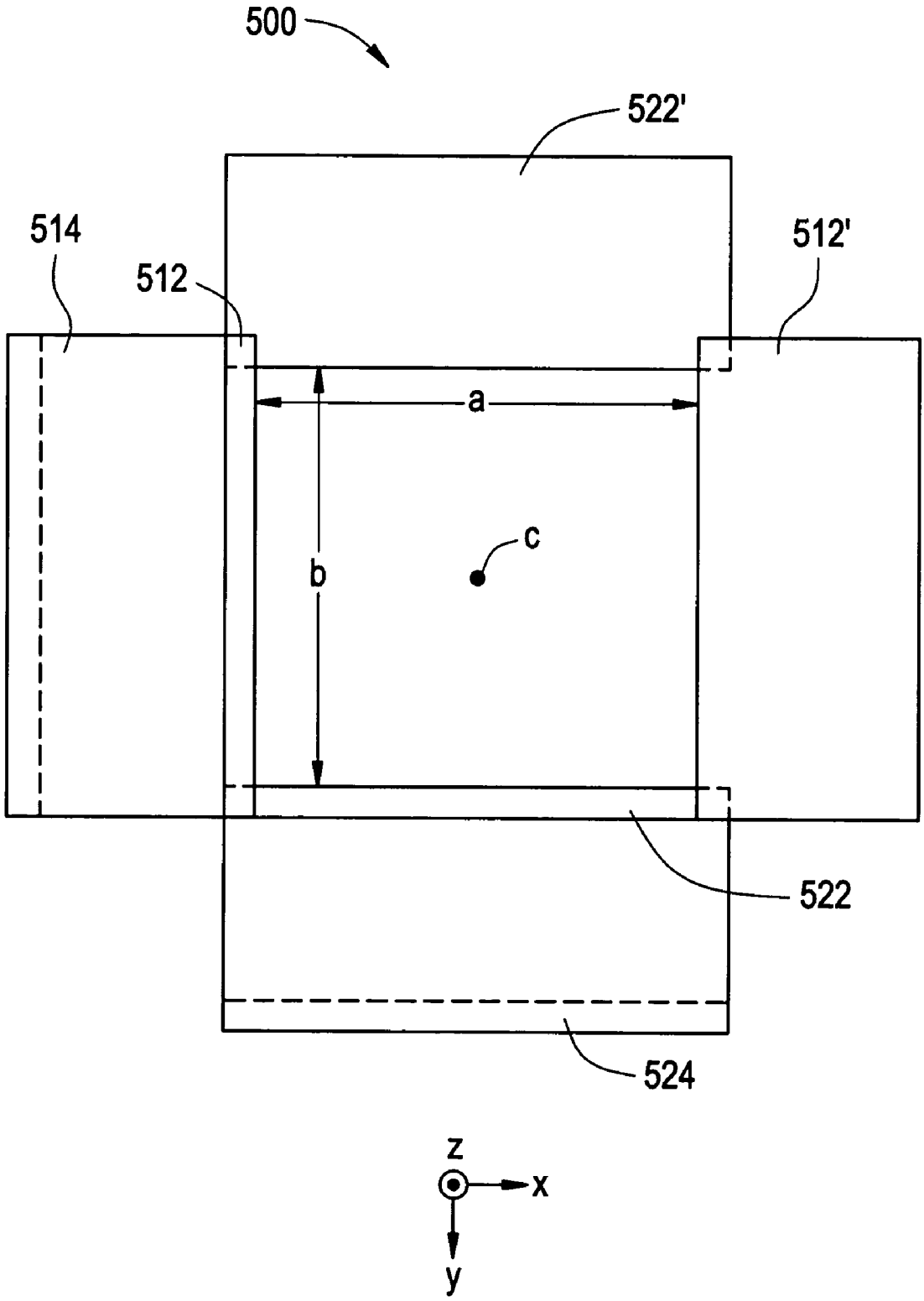
FIG. 6 illustrates in what state an aperture is formed.

FIG. 5 shows a state in which an aperture is formed by only the four symmetric blades 512, 512', 522, and 522'. In this case, the single blades 514 and 524 are in their retracted positions, not participating in the formation of aperture. The center of the aperture a×b formed by only the symmetric blades 512, 512', 522, and 522' coincides with the center C of the collimator, whereby X-ray is radiated symmetrically with respect to the collimator center C. Such an aperture will hereinafter be referred to "symmetric aperture". The shape of the symmetric aperture is square or rectangular.

The size a×b of the symmetric aperture can be changed as desired by adjusting the positions of the symmetric blades 512, 512', 522, and 522'. It is FIG. 6 that shows a maximum state of the aperture.

Figure 7:
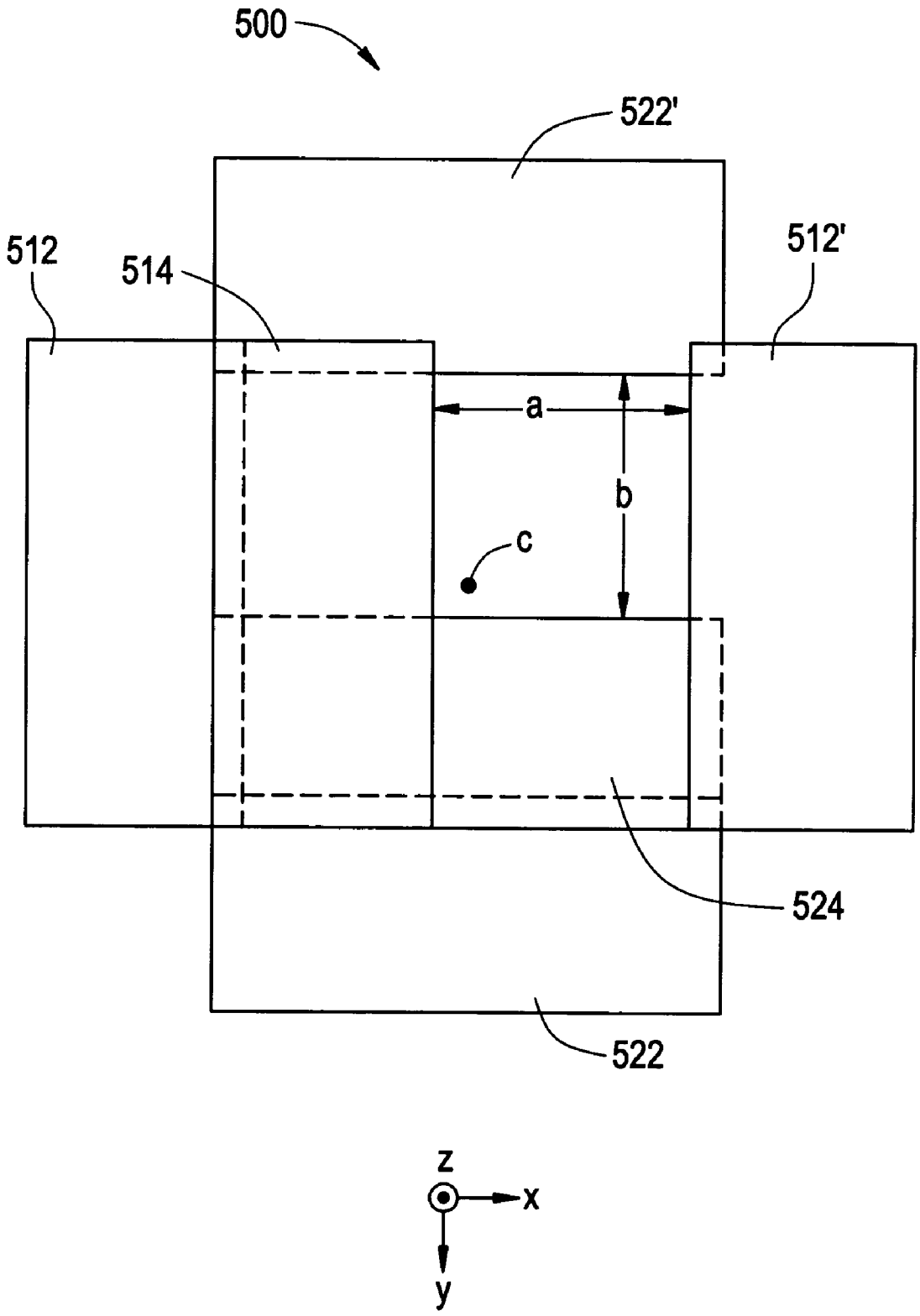
FIG. 7 illustrates in what state an aperture is formed.

By adjusting the positions of the single blades 514 and 524 with the symmetric blades 512, 512', 522, and 522' fixed to the respective positions corresponding to the maximum aperture, there can be formed such an aperture as shown in FIG. 7. As shown in the same figure, the aperture is formed by mutually opposed end faces of the single blades 514, 524 and the symmetric blades 512', 522'. By doing so, the X-ray is asymmetrically applied with respect to a collimator center C. Such an aperture will hereinafter be referred to as "asymmetric aperture". The size a×b of the asymmetric aperture can be changed as desired by adjusting the positions of the single blades 514 and 524. The shape of the asymmetric aperture is square or rectangular.

Figure 8:
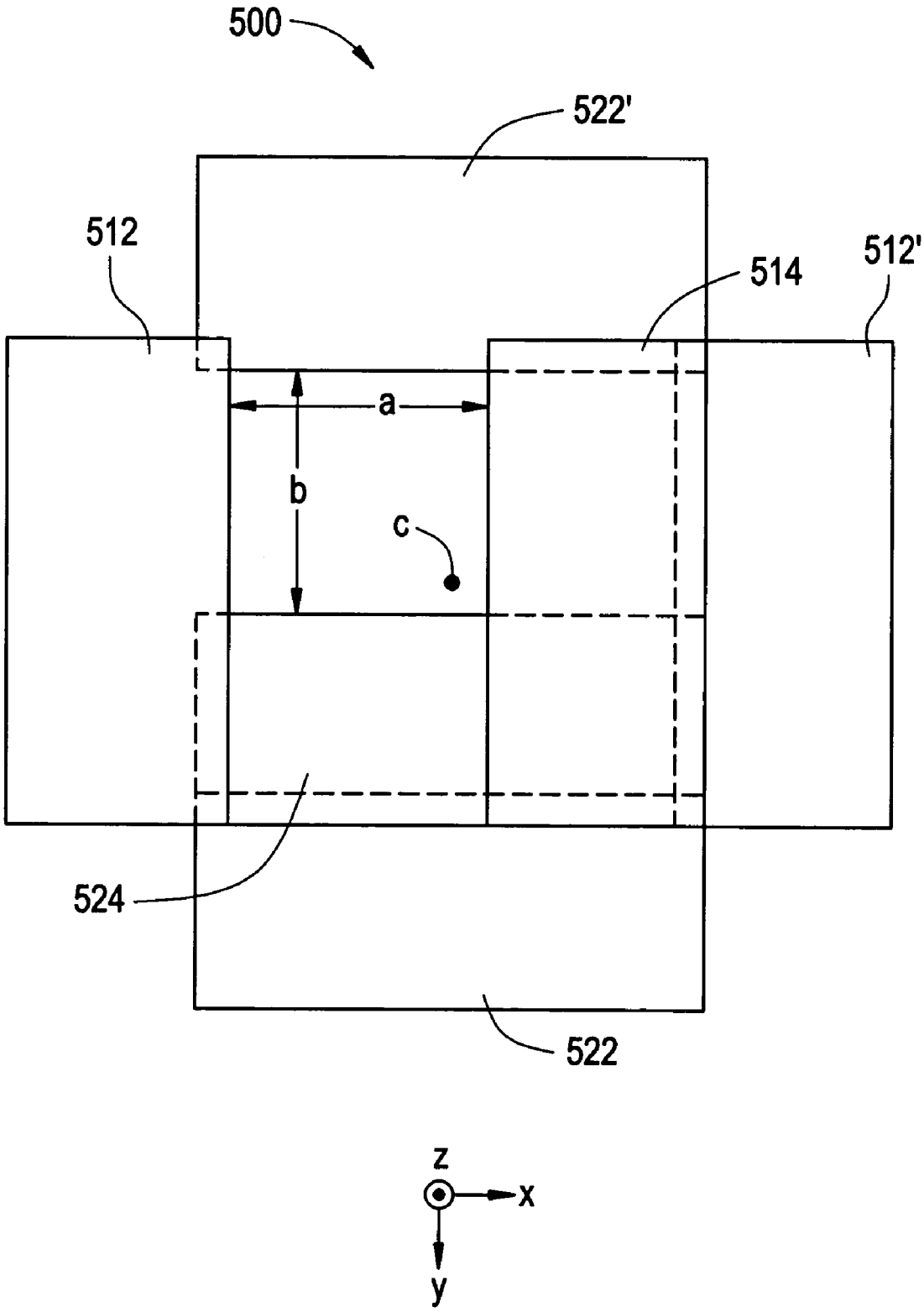
FIG. 8 illustrates in what state an aperture is formed.
Figure 9:
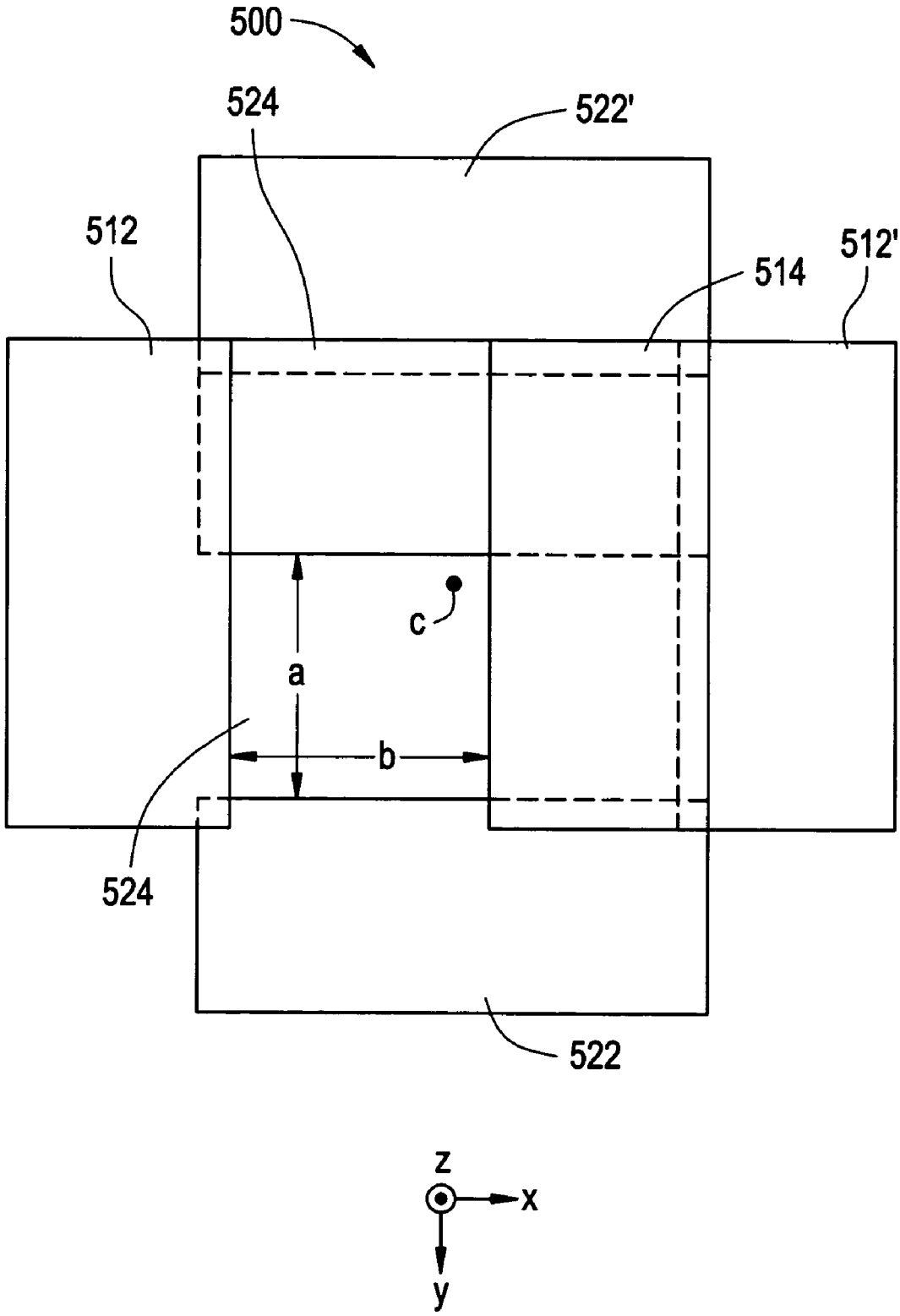
FIG. 9 illustrates in what state an aperture is formed.
Figure 10:
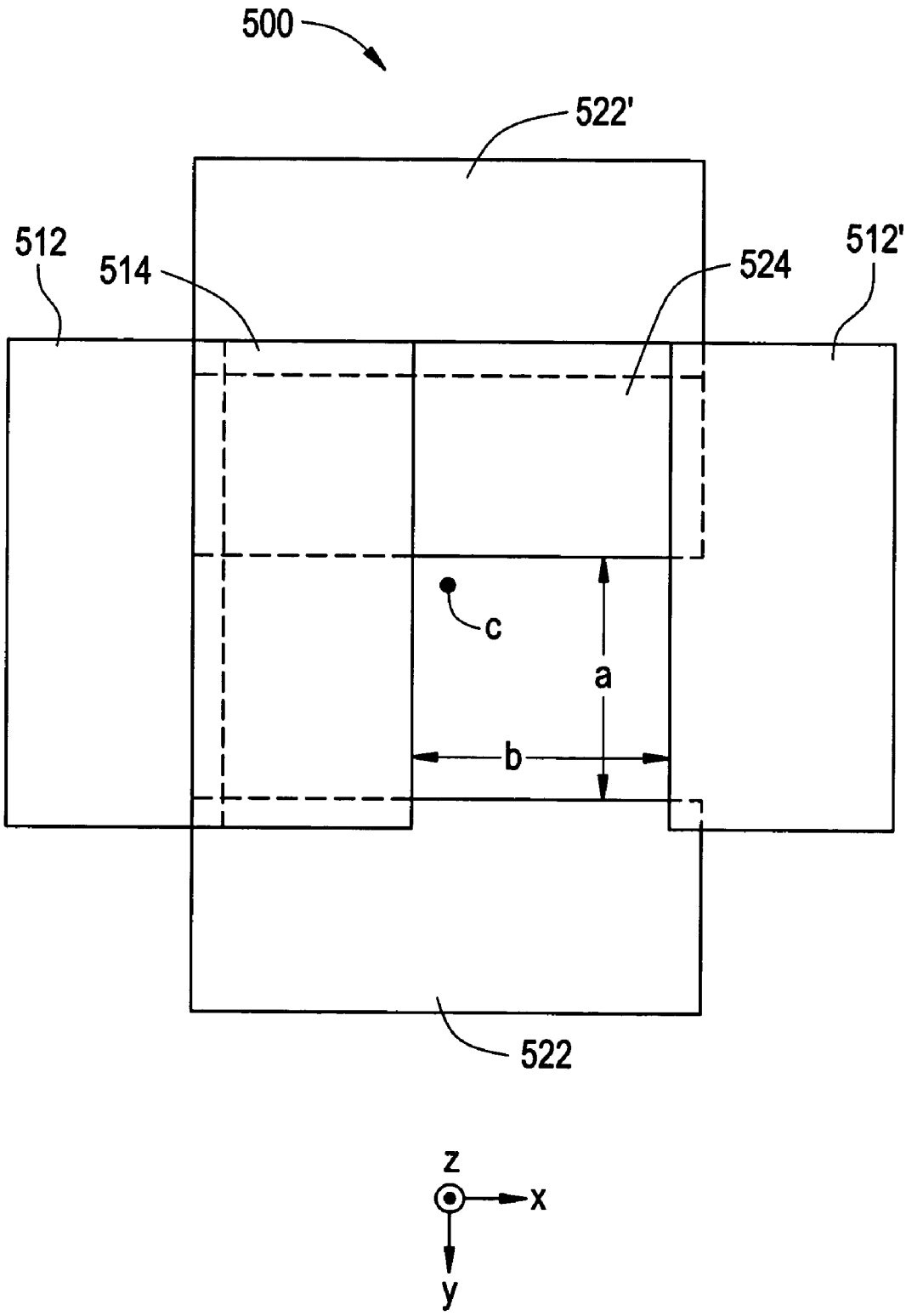
FIG. 10 illustrates in what state an aperture is formed.

The asymmetric aperture can also be formed as in FIGS. 8 to 10. In FIG. 8, an aperture is formed by mutually opposed end faces of the single blade 514, 524 and the symmetric blades 512, 522'. In FIG. 9, an aperture is formed by mutually opposed end faces of the single blade 514, 524 and the symmetric blades 512, 522. In FIG. 10, an aperture is formed by mutually opposed end faces of the single blades 514, 524 and the symmetric blades 512', 522.

Figure 11:
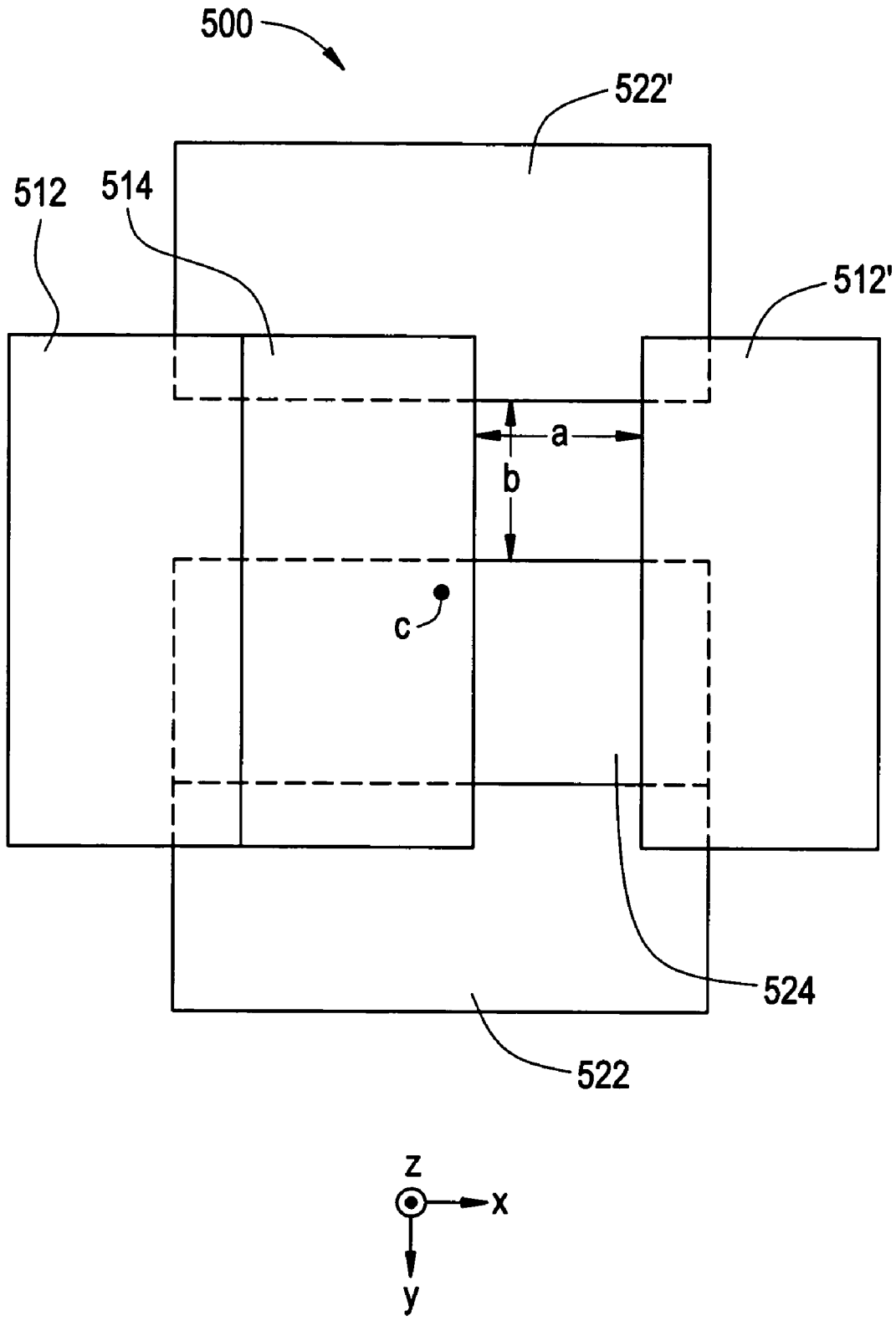
FIG. 11 illustrates in what state an aperture is formed.

By adjusting all of the positions of the symmetric blades 512, 512', 522, 522' and the single blades 514, 524 it is possible to form such an aperture as shown in FIG. 11. As shown in the same figure, an aperture is formed by mutually opposed end faces of the single blades 514, 524 and the symmetric blades 512', 522', whereby X-ray is radiated eccentrically from the collimator center C. Such an aperture will hereinafter be referred to "eccentric aperture". The size a×b of the eccentric aperture can be changed as desired by adjusting the positions of the symmetric blades 512, 512', 522, 522' and the single blades 514, 524. The shape of the eccentric aperture is square or rectangular.

Figure 12:
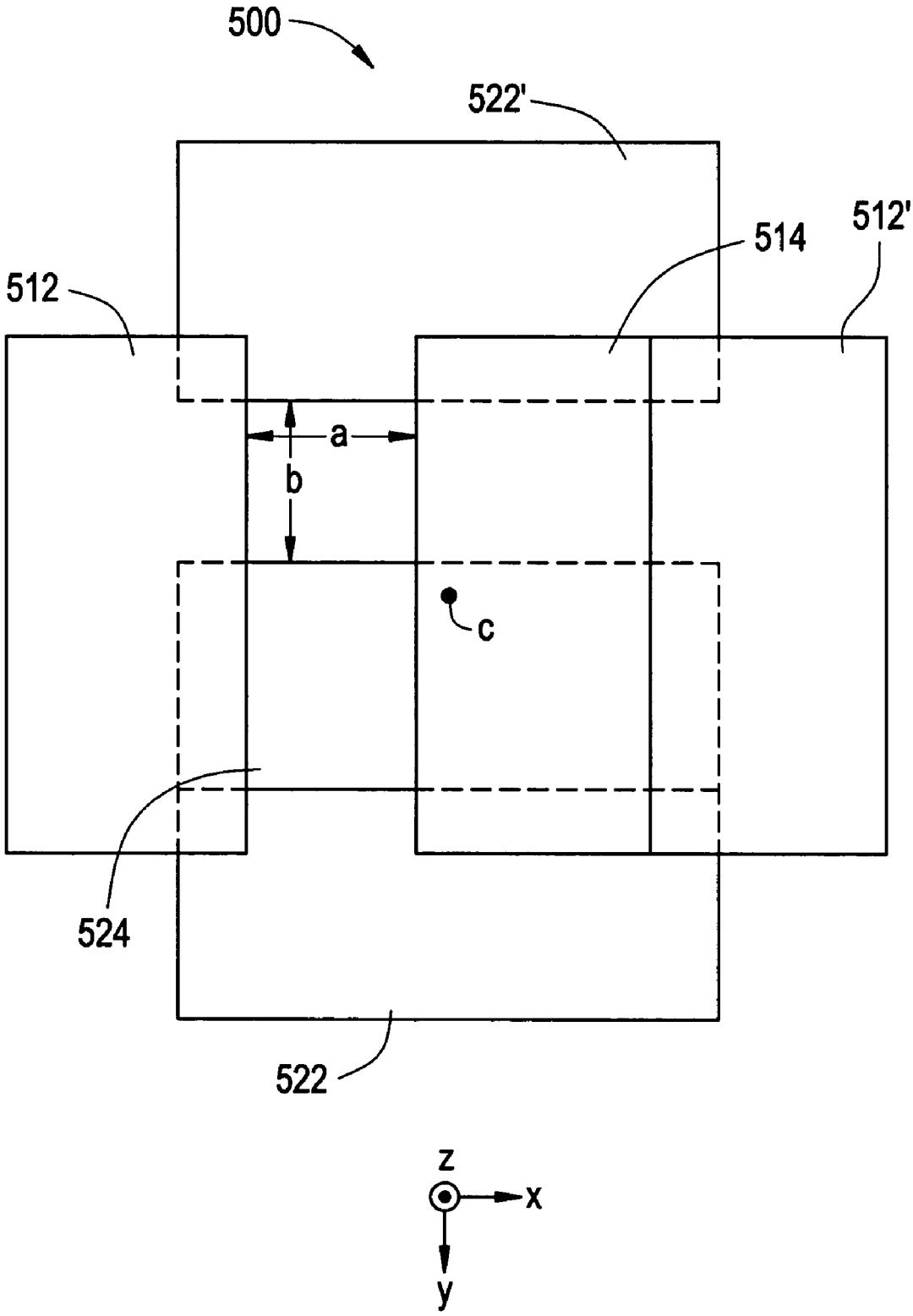
FIG. 12 illustrates in what state an aperture is formed.
Figure 13:
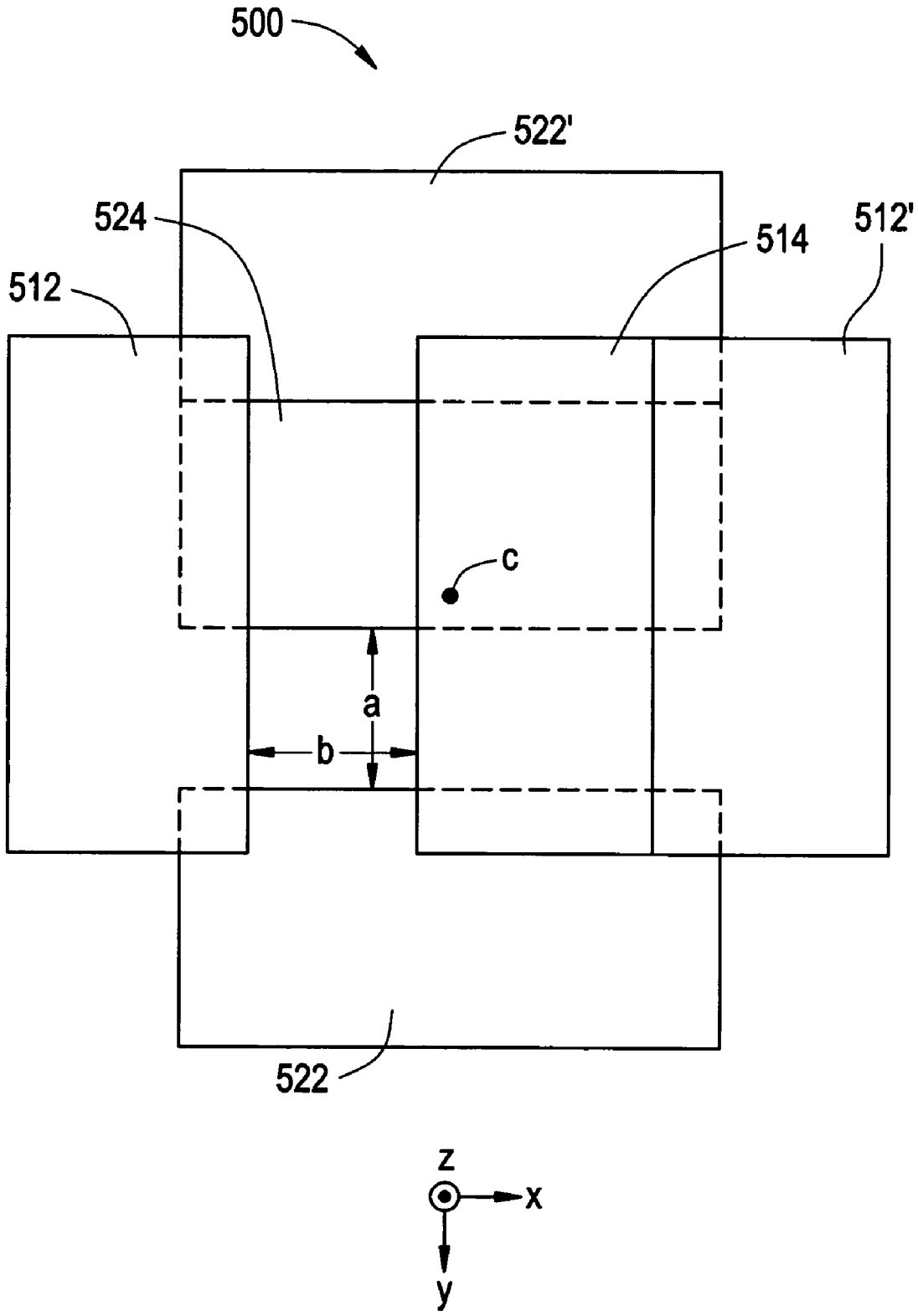
FIG. 13 illustrates in what state an aperture is formed.
Figure 14:
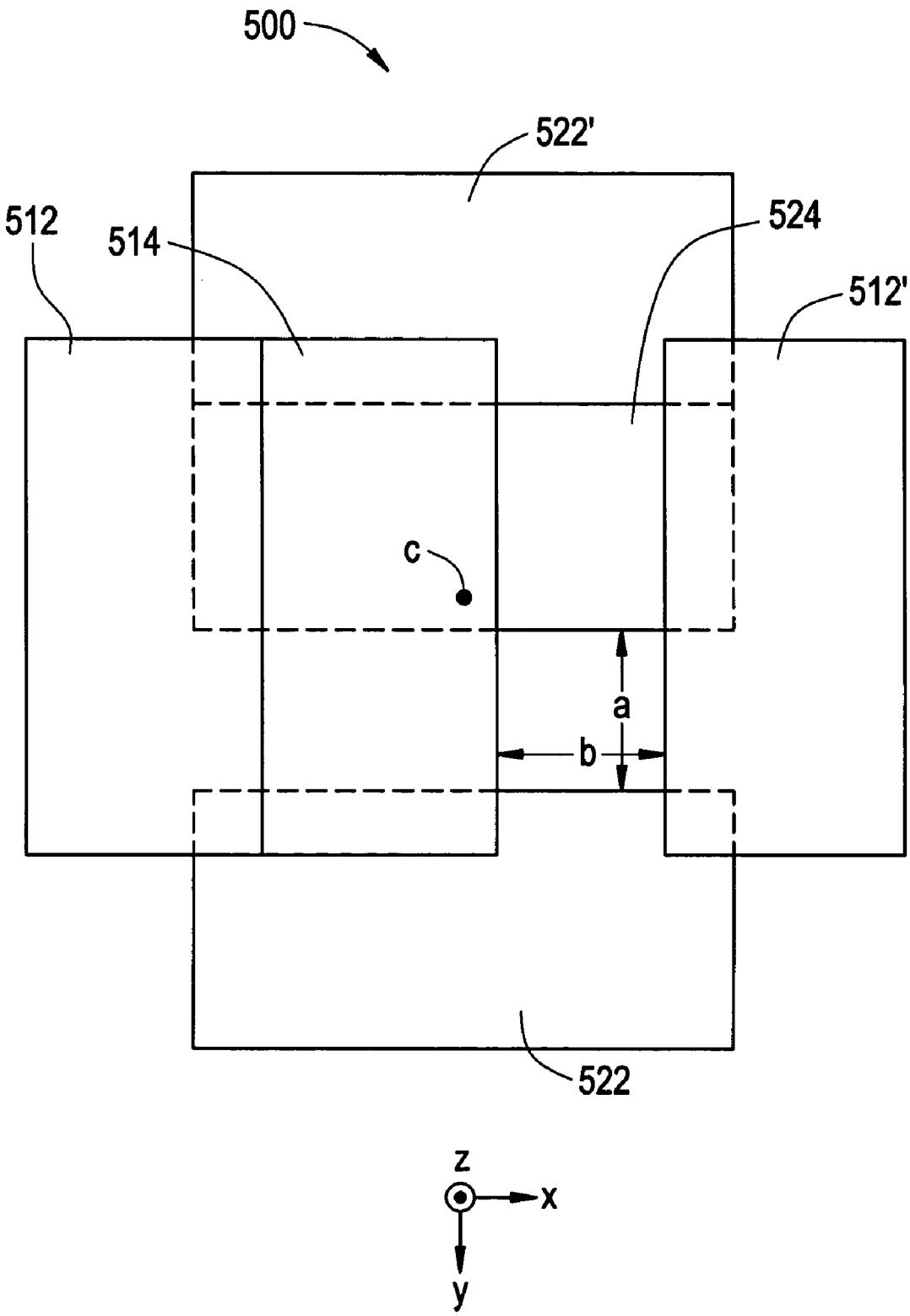
FIG. 14 illustrates in what state an aperture is formed.

It is also possible to form such eccentric apertures as shown in FIGS. 12 to 14. In FIG. 12, an aperture is formed by mutually opposed end faces of the single blades 514, 524 and the symmetric blades 512, 522'. In FIG. 13, an aperture is formed by mutually opposed end faces of the single blades 514, 524 and the symmetric blades 512, 522. In FIG. 14, an aperture is formed by mutually opposed end faces of the single blades 514, 524 and the symmetric blades 512', 522.

Thus, the collimating plate 500 has the single blades 514 and 524 in addition to the symmetric blades 512, 512', 522, and 522', so by adjusting the positions of these blades it is possible to obtain any of symmetric aperture, asymmetric aperture and eccentric aperture. Besides, since the collimating plate 500 is composed of simple plate members and a linear feed mechanism, any special blades and drive mechanism are not needed.

Figure 15:
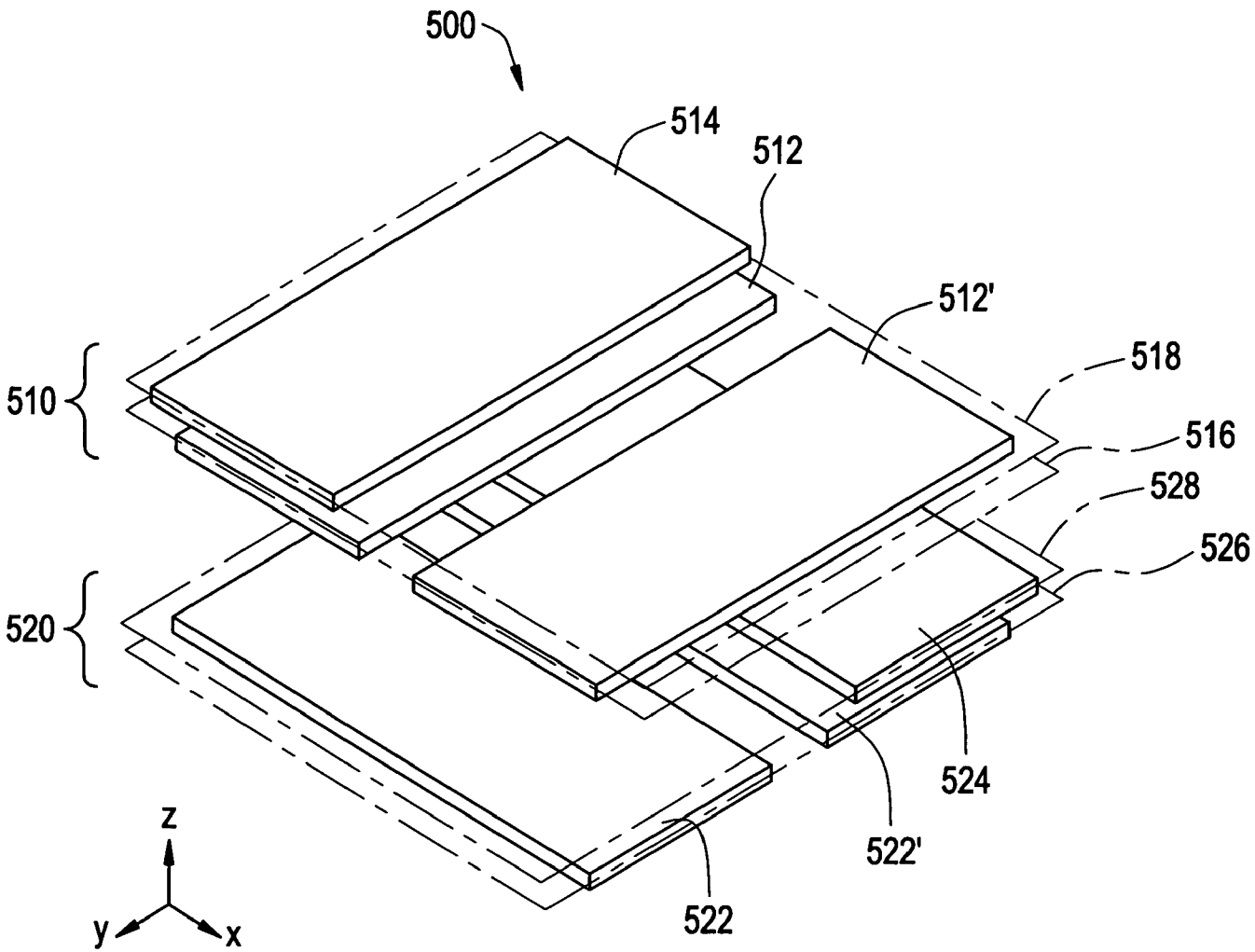
FIG. 15 illustrates the construction of a principal portion of collimating plates.

As shown in FIG. 15, the upper collimating plate 510 and the lower collimating plate 520 may be constructed respectively as unitized combinations together with their drive mechanisms. In this case, it is preferable that the symmetric blade portion and the single blade portion of each unit be separated from each other as sub units, as indicated with dotted lines.

By so doing, it becomes possible to make various combinations of sub units. For example, when only a symmetric aperture is needed, it is possible to construct a waste-free collimating plate 500 suited to the purpose of use, for example, by omitting sub units 518 and 528 and using only sub units 516 and 526.

Many widely different embodiments of the present invention may be configured without departing from the spirit and the scope of the present invention. It should be understood that the present invention is not limited to the specific embodiments described in the specification, except as defined in the appended claims.

What is claimed is:

1. A collimator comprising:

a pair of first plate members having X-ray absorbability, being movable symmetrically with each other in a direction parallel to surfaces thereof, and defining an X-ray passing aperture by a spacing between respective end faces opposed to each other;

a second plate member spaced from the first plate members in a direction perpendicular to the surfaces of the first plate members, having X-ray absorbability, and being movable in a direction parallel to a surface thereof and parallel to the moving direction of the first plate members;

a pair of third plate members spaced from the first plate members and the second plate member in a direction perpendicular to the surfaces of the first plate members and the second plate member, having X-ray absorbability, being movable symmetrically with each other in a direction parallel to surfaces thereof and perpendicular to the moving direction of the first plate members, and defining an X-ray passing aperture by a spacing between respective end faces opposed to each other; and a fourth plate member spaced from the first plate members, the second plate member, and the third plate members in a direction perpendicular to the surfaces of the first plate members, the second plate member, and the third plate members, having X-ray absorbability, and being movable in a direction parallel to a surface thereof and parallel to the moving direction of the third plate members.

2. A collimator according to claim 1, wherein the second plate member and the fourth plate member are movable independently of each other.

3. A collimator according to claim 1, wherein the first plate members and the second plate member are constructed as a unitized combination, and the third plate members and the fourth plate member are also constructed as a unitized combination.

4. A collimator according to claim 3, wherein the unitized combination of the first plate members and the second plate member is subunitized for each of the first plate members and the second plate member, and the unitized combination of the third plate members and the fourth plate member is subunitized for each of the third plate members and the fourth plate member.

5. An X-ray irradiator comprising:

an X-ray tube; and a collimator for collimating an X-ray generated from the X-ray tube;

the collimator comprising:

a pair of first plate members having X-ray absorbability, being movable symmetrically with each other in a direction parallel to surfaces thereof, and defining an X-ray passing aperture by a spacing between respective end faces opposed to each other;

a second plate member spaced from the first plate members in a direction perpendicular to the surfaces of the first plate members, having X-ray absorbability, and being movable in a direction parallel to a surface thereof and parallel to the moving direction of the first plate members;

a pair of third plate members spaced from the first plate members and the second plate member in a direction perpendicular to the surfaces of the first plate members and the second plate member, having X-ray absorbability, being movable symmetrically with each other in a direction parallel to surfaces thereof and perpendicular to the moving direction of the first plate members, and defining an X-ray passing aperture by a spacing between respective end faces opposed to each other; and a fourth plate member spaced from the first plate members, the second plate member, and the third plate members in a direction perpendicular to the surfaces of the first plate members, the second plate member, and the third plate members, having X-ray absorbability, and being movable in a direction parallel to a surface thereof and parallel to the moving direction of the third plate members.

6. An X-ray irradiator according to claim 5, wherein the second plate member and the fourth plate member are movable independently of each other.

7. An X-ray irradiator according to claim 5, wherein the first plate members and the second plate member are constructed as a unitized combination, and the third plate members and the fourth plate member are also constructed as a unitized combination.

8. An X-ray irradiator according to claim 7, wherein the unitized combination of the first plate members and the second plate member is subunitized for each of the first plate members and the second plate member, and the unitized combination of the third plate members and the fourth plate member is subunitized for each of the third plate members and the fourth plate member.

9. An X-ray apparatus comprising:

an X-ray tube;

a collimator for collimating an X-ray generated from the X-ray tube and applying the collimated X-ray to an object to be radiographed; and a detector device for detecting the X-ray which has passed through the object to be radiographed, the collimator comprising:

a pair of first plate members having X-ray absorbability, being movable symmetrically with each other in a direction parallel to surfaces thereof, and defining an X-ray passing aperture by a spacing between respective end faces opposed to each other;

a second plate member spaced from the first plate members in a direction perpendicular to the surfaces of the first plate members, having X-ray absorbability, and being movable in a direction parallel to a surface thereof and parallel to the moving direction of the first plate members;

a pair of third plate members spaced from the first plate members and the second plate member in a direction perpendicular to the surfaces of the first plate members and the second plate member, having X-ray absorbability, being movable symmetrically with each other in a direction parallel to surfaces thereof and perpendicular to the moving direction of the first plate members, and defining an X-ray passing aperture by a spacing between respective end faces opposed to each other; and a fourth plate member spaced from the first plate members, the second plate member, and the third plate members in a direction perpendicular to the surfaces of the first plate members, the second plate member, and the third plate members, having X-ray absorbability, and being movable in a direction parallel to a surface thereof and parallel to the moving direction of the third plate members.

10. An X-ray apparatus according to claim 9, wherein the second plate member and the fourth plate member are movable independently of each other.

11. An X-ray apparatus according to claim 9, wherein the first plate members and the second plate member are constructed as a unitized combination, and the third plate members and the fourth plate member are also constructed as a unitized combination.

12. An X-ray apparatus according to claim 11, wherein the unitized combination of the first plate members and the second plate member is subunitized for each of the first plate members and the second plate member, and the unitized combination of the third plate members and the fourth plate member is subunitized for each of the third plate members and the fourth plate member.

* * * * *